US005257958A

United States Patent [19]

Jagers

[11] Patent Number: 5,257,958

[45] Date of Patent: Nov. 2, 1993

[54] PRESSURE OVERRIDE CONTROL FOR AIR TREATMENT UNIT

[75] Inventor: James M. Jagers, Wyoming, Mich.

[73] Assignee: Rapid Engineering, Inc., Comstock Park, Mich.

[21] Appl. No.: 16,751

[22] Filed: Feb. 11, 1993

[51] Int. Cl.[5] ..... F24F 13/00

[52] U.S. Cl. ..... 454/238; 236/46 C; 236/13

[58] Field of Search ..... 454/70, 229, 234, 238; 236/10, 15 BG, 15 C, 17, 46 G, 46 A, 46 C, 13

[56] References Cited

U.S. PATENT DOCUMENTS

| | | | |
|---|---|---|---|
| 2,066,524 | 1/1937 | Gehnrich . | |
| 3,591,150 | 7/1971 | Weatherston . | |
| 3,611,906 | 10/1971 | Lorenz | 454/238 |
| 3,917,444 | 11/1975 | Carthew . | |
| 4,114,808 | 9/1978 | Saylor | 454/238 |
| 4,429,679 | 2/1984 | Dirkes . | |
| 4,573,912 | 3/1986 | Albritton et al. . | |
| 4,960,041 | 10/1990 | Kiser | 454/238 |

OTHER PUBLICATIONS

Product application guide entitled "Controlled Air Systems-Direct Gas Fired Make-up Air/Space Heating Equipment," published by Controlled Air Systems in the U.S.A. on or about Apr., 1990.

Product bulletin entitled "Rapid 3000, the flexible heating and ventilating system from Rapid Engineering Inc.," published by Rapid Engineering Inc. in Grand Rapids, MI, 1981.

Product bulletin entitled "Rapid 3100 Heater Series, Superior Indoor Air Quality Through Advanced Space Heating and Ventilating," published by Rapid Engineering Inc. in Grand Rapids, Mi, on or about Jul. 31, 1989.

*Primary Examiner*—Henry A. Bennet

*Attorney, Agent, or Firm*—Price, Heneveld, Cooper, DeWitt & Litton

[57] ABSTRACT

A control for an air treatment unit, such as a space heater having a heat source and an air handler that draws air from outside the space and from within the space in order to form a combined stream of air that is discharged to the space. The control includes a temperature setpoint control adapted to controlling the heating source in order regulate air temperature in the space to a particular air temperature setpoint and a temperature setpoint setback control that is adapted to decreasing the air temperature setpoint to a lower temperature setpoint during periods when it is anticipated that the space will be unoccupied. A differential pressure sensor senses a pressure differential between the space and outside of the space. A pressure control is responsive to the pressure sensor in order to control the proportion of air drawn from outside the space to air drawn from within the space. A monitor, which includes a timer, is responsive to the pressure sensed in order to determine that the pressure differential has decreased below a predetermined level for more than a predetermined length of time. A temperature and pressure changeover control responds to the monitor in order to lower the temperature setpoint to the lower temperature setpoint level and adjust the proportion of air drawn from outside the space to air drawn from within the space in a manner that decreases the proportion of outside air when the pressure differential has decreased below a predetermined level for more than the predetermined length of time.

22 Claims, 1 Drawing Sheet

PRESSURE OVERRIDE CONTROL FOR AIR TREATMENT UNIT

BACKGROUND OF THE INVENTION

This invention relates generally to controls for air treatment units and particularly to controls for pressure equilibrium modulated air intake systems which combine treated air with a modulated composite air supply of untreated outside air and air drawn from within the treated space. The invention is particularly adapted for use with direct fire air heaters.

U.S. Pat. No. 4,429,679, issued to James V. Dirkes for a MODULAIR AIR HEATER and assigned to assignee of the present application discloses a pressurized space heating apparatus wherein a fixed portion of outside air is supplied to a direct fire burner to be heated and another portion is mixed in complimentary proportions with bypassed air that is drawn from the heated space. The two portions are combined downstream of the burner to maintain space air at a substantially uniform temperature. The pressure within the space is measured with respect to outdoor air pressure. The relative pressure is used to continuously alter the complimentary proportions of unheated outside air to bypassed air in order to modulate the fixed volume of heated air and thereby maintain a fixed, slightly positive, relative pressure in the space to be heated. The air heater disclosed in Dirkes finds application primarily in industrial units such as warehouses, factories and the like. Because the control responds almost instantaneously to a condition affecting the pressure balance within the heated space, by adjusting dampers to restore equilibrium, situations can arise which result in excessive energy loss. For example, when a large opening is created in the envelope of the space, for example, when a freight door is left open, the control will respond to the decrease in positive pressure within the space by modulating the dampers to bring in more outside air in order to increase the positive pressure within the space. Because the amount of air exiting the space must balance the infiltration of outdoor air, the result is a significant increase in the exchange of heated air from the space with the outdoors. This aggravates the loss of energy otherwise resulting from the open door.

SUMMARY OF THE INVENTION

The present invention is intended to reduce the amount of energy lost in pressure equilibrium modulated air intake systems by detecting an undesirable condition and taking appropriate corrective action. The present invention is embodied in a control for an air treatment unit having a treating device for treating air delivered to a space and an air handler that draws air from outside the space and from within the space in order to form a combined stream of air that is discharged to the space. The air handler adjusts the proportion of air drawn from outside the space to the bypass air drawn from within the space. The control includes a differential pressure sensor adapted to sensing a pressure differential between the space and outside of the space and a pressure control that is responsive to the pressure sensor. The pressure control controls the proportion of air drawn from outside the space to the air drawn from within the space in order to maintain a particular setpoint pressure differential between the space and outside of the space. According to the invention, a monitor is provided that includes a timer and is responsive to the pressure sensor in order to determine that the pressure differential has decreased below a predetermined level for more than a predetermined length of time. The control may further include a pressure changeover control that is responsive to the monitor in order to adjust the proportion of air drawn from outside the air space to air drawn from within the space in a manner that decreases the proportion of outside air whenever the pressure differential has decreased below the predetermined level for more than the predetermined length of time.

A control according to another aspect of the invention includes a temperature setpoint control that is adapted to controlling the treating device in order to regulate air temperature in the space to a particular air temperature setpoint. A temperature changeover control is provided that is responsive to the monitor in order to change the temperature setpoint when the sensed pressure differential has decreased below the predetermined level for more than the predetermined length of time. In a preferred form, the control includes a temperature setback control that is adapted to changing the air temperature setpoint during periods when it is anticipated that the space will be unoccupied, for example, at night and on weekends. An override is provided that is responsive to the setback control in order to inhibit the monitor during periods when it is anticipated that the space will be unoccupied in order to avoid actuation of the pressure and/or temperature changeover controls.

In a most preferred form, the air handler is capable of decreasing the proportion of air drawn from outside the space to air drawn from within the space to a predetermined minimum proportion that is greater than zero. Because a finite amount of air from outside the space is drawn, even during abnormal space pressure conditions, the control will respond to removal of the abnormal condition by restoring the pressure equilibrium to the space. This will allow the monitor to be self-resetting in response to the restored pressure equilibrium and, in turn, will cancel the pressure and/or temperature override controls.

A control according to the invention determines that an undesirable pressure condition exists within the space and initiates appropriate action. The pressure changeover control overrides the control of the air treatment unit by significantly decreasing the amount of outside air infiltrated to the space. This reduces the amount of air interchange between the space and the outdoors. The temperature changeover control places the air treatment unit control in an unoccupied mode which significantly reduces the amount of energy put into, or taken out of, the space. If the invention is applied to a space heater, the setpoint temperature will be significantly lowered, reducing the Btu output of the burner.

These and other objects, advantages and features of this invention will become apparent upon review of the following specification in conjunction with the drawings.

DESCRIPTION OF THE PREFERRED EMBODIMENT

Figure 1:
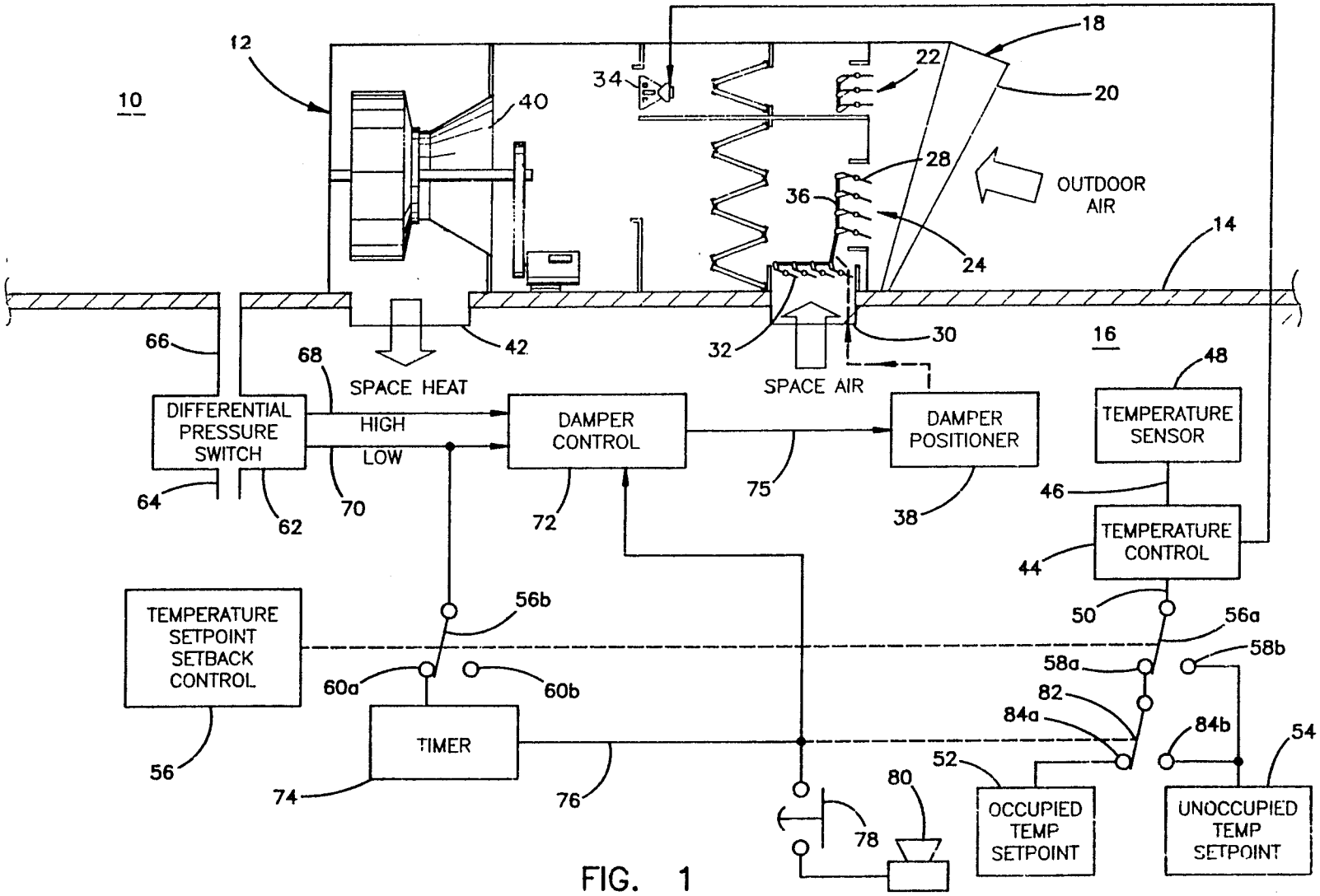
FIG. 1 is a block diagram of a composite mechanical and electrical control system for an air treatment unit according to the invention.

Referring now specifically to the drawing, and the illustrative embodiments depicted therein, an air treatment unit 10 includes a modular air heater 12 which is illustrated as mounted to the roof 14 of a building space 16 (FIG. 1). Modular air heater 12 is provided according to the teachings of U.S. Pat. No. 4,429,679, the disclosure of which is hereby incorporated herein by reference. Air heater 12 is disclosed in detail in the '679 patent and will not be repeated herein. Suffice to say, air heater 12 includes an air handling unit 18 having an outdoor air inlet 20 including first and second air admitting openings 22 and 24. Air admitting openings 22 and 24 are served by inlet dampers 26 and 28, respectively. A return air duct 30 communicates with space 16 and is served by an inlet damper 32. Inlet opening 22 supplies outdoor air to a direct fire burner 34. Inlet damper 28, serving second air admitting opening 24, is mechanically linked by segmented linkage 36 to operate in opposition to the inlet damper 32 serving return air duct 30. Linkage 36 is controlled by a damper positioner 38 in order to modulate the proportion of outdoor air and space air supplied to a constant-speed impeller fan 40. The proportion of air drawn over burner 34 through air admitting opening 22 is a fixed proportion, such as 20%, of the total air volume supplied by fan 40 through space heat duct 42. However, the remaining 80% of air volume supplied by fan 40 to duct 42 is modulated between outdoor air, supplied through air admitting opening 24, and bypassed space air, delivered through return air duct 30 as a function of the position of linkage 36 as established by damper positioner 38.

Burner 34 has a 25 to 1 turndown ratio, the value of which is set by a temperature control 44. Temperature control 44 receives a first input 46 from a temperature sensor 48 in order to determine the temperature within space 16. Temperature control 44 receives a second input 50 from one of an occupied temperature setpoint module 52 and an unoccupied temperature setpoint module 54. When occupied temperature setpoint module 52 is connected with input 50, temperature control 44 modulates burner 34 in order maintain the space within temperature 16 at a temperature setpoint established by setpoint module 52. When unoccupied temperature setpoint module 54 is connected with input 50, temperature control 44 modulates burner 34 to maintain the temperature in space 16 at a temperature setpoint established by setpoint module 54, which is typically a lower temperature setpoint than that established by module 52. A temperature setpoint setback control 56 has a first output, illustrated as output contact **56*a* and a second output, illustrated as contact 56*b*. Output contact 56*a* is operated by setback control 56 between a first position, illustrated as engaging a stationary contact 58*a*, and a second position, illustrated as engaging a stationary contact 58*b*. Likewise, output contact 56*b* is operated by setback control between a first position in which it is illustrated as engaging a stationary contact 60*a* and a second position in which it is illustrated as engaging a stationary contact 60*a* and a second position in which it is illustrated as engaging a stationary contact 60*b*. As is conventional, temperature setback control 56 is operated by a time clock (not shown) in order to switch outputs 56*a*, 56*b* between an occupied mode as illustrated in FIG. 1 and an unoccupied mode in which output contact 56*a* engages stationary contact 58*b* and output contact 56*b* engages stationary contact 60*b***.

A differential pressure switch 62 has a first sensing input 64, which is responsive to the pressure of the air within space 16 and a second sensing input 66 which is responsive to the outdoor air pressure, outside of space 16. Differential pressure switch 62 is responsive to the difference in pressure sensed by inputs 64 and 66 in order to produce an indication on a "high" output 68 when the pressure differential between space 16 and outdoor air is above a first predetermined level and to produce an indication on a "low" output 70 when the pressure differential between space 16 and outdoors is below a second predetermined level. The first and second levels could be set at the same pressure differential level. A damper control 72 responds to high and low outputs 68, 70 by producing an indication on an output 75 supplied to damper positioner 38 to cause the damper positioner to modulate the ratio of bypassed space air and outdoor air by adjusting linkage 36. Thus, if differential pressure switch 62 produces an indication on output 68 that the relative pressure of space 16 is too high, damper control 72 instructs damper positioner 38 to decrease the proportion of outdoor air drawn into space 16. If differential pressure switch 62 produces an indication on output 70 that the relative pressure of space 16 is too low, damper control 72 instructs damper positioner 38 to increase the amount of outdoor air admitted to space 16.

Air treatment unit 10 includes a monitor composed of a timer 74 which is connected with "low" output 70 of differential pressure switch 62 through stationary setback control output contact **56*b*. Timer 74 has an output 76 which is supplied as a pressure change over signal to damper control 72, and through a disconnect switch 78, to an alarm 80. Output 76 additionally actuates a temperature changeover switch 82 between a first position, as shown in FIG. 1, illustrated as engaging a stationary contact 84*a* and a second position illustrated as engaging a stationary contact 84*b*. Timer 74, in the illustrated embodiment, is set for a suitable length of time to indicate that an abnormal pressure condition is not transitory, such as 10 minutes. Timer 74 responds to an indication on output 70 persisting for this predetermined length of time by producing an indication on output 76. Timer 74 will respond to output 70 only if output 56*b* of setback control 56 is in the occupied temperature mode and, therefore, engaging stationary contact 60*a***.

Under normal conditions, the indication on "low" output 70 would cause damper control 72 to instruct damper positioner 38 to increase the proportion of outdoor air admitted to space 16. If the low pressure condition persists, damper positioner 38 would eventually modulate the ratio of outdoor air to air bypassed from space 16 to a maximum of outdoor air, or minimum amount of bypassed space air. When timer 74 produces an indication on output 76, a pressure changeover signal is provided to damper control 72. The effect of the pressure changeover indication on output 76 from timer 74 is to cause damper control 72 to instruct damper positioner 38 to modulate the ratio of air in order to admit a minimum amount of outdoor air to space 16. Concurrently with issuing a changeover command, the indication on output 76 will cause alarm 80 to alert personnel within space 16 of the abnormal condition caused by an indication on "low" output 70 for longer than the preset time of timer 74. Disable switch 78 is provided in order to allow personnel to discontinue the signal issued from alarm 80.

The indication on output 76 that an abnormal pressure condition has existed for more than the predetermined length of time set for timer 74 causes temperature changeover switch 82 to switch from the position illustrated in FIG. 1 to a position engaging stationary contact 84*b*. This switching of temperature changeover control 82 causes temperature control 44 to be responsive to unoccupied temperature setpoint module 54. Thus, when an abnormal pressure condition exists for more than the predetermined time established by timer 74, the temperature setpoint for space 16 is lowered in order to turn down the heat output of burner 34 in order to conserve energy during the abnormal condition.

When temperature setpoint setback control 56 is in the unoccupied mode, output 56*b* will be switched into engagement with stationary contact 60*b*, which will disconnect timer 74 from engagement with output 70. Thus, during anticipated unoccupied conditions of space 16, the monitoring of differential pressure switch 62 is inhibited. In such unoccupied mode, output contact 56*a* engages fixed contact 58*b* so that temperature control 50 is responsive to unoccupied temperature setpoint 54. Accordingly, the heat output of burner 34 is already reduced. Therefore, there is no need to respond to abnormal relative pressure conditions in space 16. In addition, it is expected that conditions which would cause the abnormal pressure condition to exist are less likely when space 16 is not occupied.

In operation, when an occupant of space 16 intentionally, or inadvertently, leaves a door or other opening uncovered, the pressure sensed by differential pressure switch 62 is decreased. If the decrease is sufficient, it will cause pressure switch 62 to produce an indication on output 70 which causes damper control 72 to instruct damper positioner 38 to admit additional outdoor air in order to reestablish pressure equilibrium in space 16. Simultaneously, timer 74 monitors the length of the "low" pressure indication, provided that temperature setpoint setback control 56 is in the "occupied" mode. If the abnormal pressure condition exists for longer than the time set for timer 74, an indication will be produced on output 76 which will cause the following events to occur: (a) alarm 80 to sound; (b) damper control 72 to instruct damper positioner 38 to adjust the position of dampers 28 and 32 to a maximum bypass of space air and a minimum amount of admitted outdoor air; and (c) actuate temperature changeover switch 82 in order to cause temperature control 44 to be responsive to the unoccupied temperature setpoint module 54, thus reducing the heat output of burner 34. Air handler 18 is only capable of decreasing the proportion of outdoor air admitted to space 16 to a predetermined minimum level, such as 20%. When the uncovered opening of space 16 is again closed, modular air heater 12 will, thus, rapidly return the differential pressure of space 16 with respect to outdoor air to a positive pressure condition. When the normal pressure condition is re-established in space 16, pressure differential switch 62 will remove the "low pressure" indication on output 70. This will cause timer 74 to remove the pressure changeover command from damper control 72 and the temperature changeover command from control 82 in order to allow damper positioner 38 to return the position of dampers 28 and 32 to a normal operating position consistent with maintaining a slightly positive relative pressure of space 16 as established by the setpoint of differential pressure switch 62. Removal of the changeover command from temperature changeover control 82 will return control 82 into engagement with contact 84*a*. Temperature control 44 will again be responsive to occupied temperature setpoint module 52, if temperature setpoint setback control 56 is in the occupied mode, in order to increase the heat output of burner 34 and thereby establish a temperature setpoint more appropriate for the occupied status of space 16.

In the illustrated embodiment, air heater 12 is a Model 3100 direct fire space heater marketed by Rapid Engineering, Inc., Grand Rapids, Mich. Temperature control 44, including temperature setpoint modules 52 and 54 are marketed as a Series 44 system by Maxitrol Corporation. Damper control 72 and positioner 38 are marketed as Model M6284 damper motor and Model R927 balancing relay by Honeywell, Inc., Minneapolis, Minn. Differential pressure switch 62 is marketed as Model 1640 by Dwyer Instruments, Inc.

It should be understood that the control system for the air treatment unit in FIG. 1 is for illustrative purposes only and would typically be embodied in a system implemented with relay logic or a programmable logic controller. Although the invention is illustrated with a direct fire modular heater, it may find applicability to a heater incorporating a heat exchange unit. Although the invention is illustrated with an air handler that provides a fixed flow of combustion air to the burner and modulates the air which bypasses the burner between space and outside air, it may also be applied to air handlers which modulate the proportion of space and outside air either supplied to the burner or downstream of the burner. Additionally, the invention may be applied to pressure equilibrium modulated air intake systems incorporating air conditioning equipment and other air treating means.

Changes and modifications in the specifically described embodiments can be carried out without departing from the principles of the invention, which is intended to be limited only by the scope of the appended claims, as interpreted according to the principles of patent law including the Doctrine of Equivalents.

The embodiments of the invention in which an exclusive property or privilege is claimed are defined as follows:

1. A control for an air treatment unit having a treating device for treating air delivered to a space and an air handler that draws air from outside said space and from within said space in order to form a combined stream of air that is discharged to said space, and adjusts the proportion of air drawn from outside said space to the air drawn from within said space; said control comprising:

a differential pressure sensor adapted to sensing a pressure differential between said space and outside of said space;

a pressure control that is responsive to said pressure sensor and adapted to controlling said proportion of air drawn from outside said space to the air drawn from within said space in order to maintain a particular setpoint pressure differential between said space and outside of said space; and a monitor that includes a timer and is responsive to said pressure sensor in order to determine that said pressure differential has decreased below a predetermined level for more than a predetermined length of time.

2. The control of claim 1 including a pressure changeover control that is responsive to said monitor in order to adjust said proportion of air drawn from outside said space to air drawn from within said space in a manner that decreases said proportion when said pressure differential has decreased below said predetermined level for more than said predetermined length of time.

3. The control of claim 1 including a temperature setpoint control that is adapted to controlling said treating device in order to regulate air temperature in said space to a particular air temperature setpoint and a temperature changeover control that is responsive to said monitor in order to change said temperature setpoint when said pressure differential has decreased below said predetermined level for more than said predetermined length of time.

4. The control of claim 3 including a pressure changeover circuit that is responsive to said monitor in order to adjust said proportion of air drawn from outside said space to air drawn from within said space in a manner that decreases said proportion when said pressure differential has decreased below said predetermined level for more than said predetermined length of time.

5. The control of claim 3 including a temperature setpoint setback control that is adapted to changing said air temperature setpoint during periods when it is anticipated said space will be unoccupied and an override that is responsive to said setback control in order to inhibit said monitor during periods when it is anticipated said space will be unoccupied.

6. An air treatment unit for treating air in a space comprising:

a treating device that is adapted to treating air delivered to said space;

an air handler that draws air from outside said space and from within said space in order to form a combined stream of air that is discharged to said space, said air handler being capable of adjusting the proportion of air drawn from outside said space to the air drawn from within said space;

a differential pressure sensor that is adapted to sensing a pressure differential between said space and outside of said space;

a pressure control that is responsive to said pressure sensor and adapted to controlling said proportion of air drawn from outside said space to the air drawn from within said space in order to maintain a particular setpoint pressure differential between said space and outside of said space; and a monitor that includes a timer and is responsive to said pressure sensor in order to determine that said pressure differential has decreased below a predetermined level for more than a predetermined length of time.

7. The air treatment unit of claim 6 including a pressure changeover control that is responsive to said monitor in order to adjust said proportion of air drawn from outside said space to air drawn from within said space in a manner that decreases said proportion when said pressure differential has decreased below said predetermined level for more than said predetermined length of time.

8. The air treatment unit of claim 7 wherein said air handler is capable of decreasing said proportion of air drawn from outside said space to air drawn from within said space to a predetermined minimum proportion that is greater than zero, whereby sufficient air will be drawn from outside of said space to cause said pressure differential to increase above said predetermined level in order to reset said monitor in response to elimination of the condition causing the pressure differential to decrease below said predetermined level.

9. The air treatment unit of claim 6 including a temperature setpoint control that is adapted to controlling said treating device in order to regulate air temperature in said space to a particular air temperature setpoint and a temperature changeover circuit that is responsive to said monitor in order to change said temperature setpoint when said pressure differential has decreased below said predetermined level for more than said predetermined length of time.

10. The air treatment unit of claim 9 including a pressure changeover control that is responsive to said monitor in order to adjust said proportion of air drawn from outside said space to air drawn from within said space in a manner that decreases said proportion when said pressure differential has decreased below said predetermined level for more than said predetermined length of time.

11. The air treatment unit of claim 9 including a temperature setpoint setback control that is adapted to changing said air temperature setpoint during periods when it is anticipated said space will be unoccupied and an override that is responsive to said setback control in order to inhibit said monitor during periods when it is anticipated said space will be unoccupied.

12. The air treatment unit of claim 6 wherein said treating device is a heat source.

13. The air treatment unit of claim 12 wherein said heat source is a direct fire air heater.

14. The air treatment unit of claim 6 including an alarm that is responsive to said monitor in order to indicate when said pressure differential has decreased below said predetermined level for more than said predetermined length of time.

15. A control for a space heater having a heat source that is adapted to heating air delivered to a space and an air handler that draws air from outside said space and from within said space in order to form a combined stream of air that is discharged to said space, and adjusts the proportion of air drawn from outside said space to the air drawn from within said space; said control comprising:

a temperature setpoint control adapted to controlling said heating source in order to regulate air temperature in said space to a particular air temperature setpoint;

a temperature setpoint setback control that is adapted to decreasing said air temperature setpoint to a lower temperature setpoint during periods when it is anticipated said space will be unoccupied;

a differential pressure sensor adapted to sensing a pressure differential between said space and outside of said space;

a pressure control that is responsive to said pressure sensor and adapted to controlling said proportion of air drawn from outside said space to the air drawn from within said space in order to maintain a particular setpoint pressure differential between said space and outside of said space;

a monitor that includes a timer and is responsive to said pressure sensor in order to determine that said pressure differential has decreased below a predetermined level for more than a predetermined length of time; and a temperature and pressure changeover control that is responsive to said monitor in order to lower said temperature setpoint to said lower temperature setpoint and to adjust said proportion of air drawn from outside said space to air drawn from within said space in a manner that decreases said proportion, when said pressure differential has decreased below said predetermined level for more than said predetermined length of time.

16. The heater control of claim 15 further including an override that is responsive to said setback control in order to inhibit said monitoring means during periods when it is anticipated said space will be unoccupied.

17. The heater control of claim 15 further including an alarm that is responsive to said monitor in order to indicate when said pressure differential has decreased below said predetermined level for more than said predetermined length of time.

18. A space heater for heating a space comprising:

a heat source that is adapted to heating air delivered to said space;

an air handler that draws air from outside said space and from within said space in order to form a combined stream of air that is discharged to said space, said air handler being capable of adjusting the proportion of air drawn from outside said space to the air drawn from within said space;

a temperature setpoint control that is adapted to controlling said heat source in order to regulate air temperature in said space to a particular air temperature setpoint;

a temperature setpoint setback control that is adapted to decreasing said air temperature setpoint to a lower temperature setpoint during periods when it is anticipated said space will be unoccupied;

a differential pressure sensor adapted to sensing a pressure differential between said space and outside of said space;

a pressure control that is responsive to said pressure sensor and adapted to controlling said proportion of air drawn from outside said space to the air drawn from within said space in order to maintain a particular setpoint pressure differential between said space and outside of said space;

a monitor that includes a timer and is responsive to said pressure sensor in order to determine that said pressure differential has decreased below a predetermined level for more than a predetermined length of time; and a pressure and temperature changeover control that is responsive to said monitor in order to lower said temperature setpoint to said lower temperature setpoint and to adjust said proportion of air drawn from outside said space to air drawn from within said space in a manner that decreases said proportion, when said pressure differential has decreased below said predetermined level for more than said predetermined length of time.

19. The heater control of claim 18 further including an override that is responsive to said temperature setpoint setback control in order to inhibit said monitor during periods when it is anticipated said space will be unoccupied.

20. The heater control of claim 18 further incouding an alarm that is responsive to said monitor in order to indicate when said pressure differential has decreased below said predetermined level for more than said predetermined length of time.

21. The space heater of claim 18 wherein said air handler is capable of decreasing said proportion of air drawn from outside said space to air drawn from within said space to a predetermined minimum proportion that is greater than zero, whereby sufficient air will be drawn from outside of said space to cause said pressure differential to increase above said predetermined level in order to reset said monitor in response to elimination of the condition causing the pressure differential to decrease below said predetermined level.

22. The space heater of claim 16 wherein said heat source is a direct fire air heater.

* * * * *

UNITED STATES PATENT AND TRADEMARK OFFICE

CERTIFICATE OF CORRECTION

PATENT NO. : 5,257,958

DATED : November 2, 1993

INVENTOR(S) : James M. Jagers

It is certified that error appears in the above-indentified patent and that said Letters Patent is hereby corrected as shown below:

Column 10, Line 22
"incouding" should be --including--;

Signed and Sealed this

Thirtieth Day of August, 1994

Bruce Lehman

*Attest:*

BRUCE LEHMAN

*Attesting Officer*

*Commissioner of Patents and Trademarks*